US011691169B2

(12) United States Patent
Pipe

(10) Patent No.: US 11,691,169 B2
(45) Date of Patent: Jul. 4, 2023

(54) PROTECTED FIRE PROTECTION SPRINKLER AND TOOL ASSEMBLIES

(71) Applicant: Minimax Viking Research & Development GmbH, Bad Oldesloe (DE)

(72) Inventor: Jed Edmond Pipe, Byron Center, MI (US)

(73) Assignee: Minimax Viking Research & Development GmbH, Bad Oldesloe (DE)

( * ) Notice: Subject to any disclaimer, the term of this patent is extended or adjusted under 35 U.S.C. 154(b) by 0 days.

(21) Appl. No.: 17/796,795

(22) PCT Filed: Mar. 2, 2021

(86) PCT No.: PCT/US2021/020497

§ 371 (c)(1),
(2) Date: Aug. 1, 2022

(87) PCT Pub. No.: WO2021/178421

PCT Pub. Date: Sep. 10, 2021

(65) Prior Publication Data

US 2023/0050624 A1 Feb. 16, 2023

Related U.S. Application Data

(60) Provisional application No. 62/984,574, filed on Mar. 3, 2020.

(51) Int. Cl.

| | |
|---|---|
| ***B05B 15/16*** | (2018.01) |
| ***A62C 37/11*** | (2006.01) |
| ***A62C 37/09*** | (2006.01) |

(52) U.S. Cl.

CPC ..... *B05B 15/16* (2018.02); *A62C 37/09* (2013.01); *A62C 37/11* (2013.01)

(58) Field of Classification Search

CPC ..... A62C 37/09; A62C 37/11; A62C 37/12; A62C 37/14; A62C 37/16; A62C 37/20; B05B 15/16

See application file for complete search history.

(56) References Cited

U.S. PATENT DOCUMENTS 2,389,333 A * 11/1945 Tyden ..... A62C 37/09 169/40
4,066,129 A * 1/1978 Anderson ..... A62C 37/10 285/46

(Continued)

OTHER PUBLICATIONS

International Searching Authority, International Search Report and Written Opinion in International Appln. No. PCT/US2021/020497, dated May 6, 2021, 14 pp.

(Continued)

*Primary Examiner* — Darren W Gorman
(74) *Attorney, Agent, or Firm* — Perkins Coie LLP

(57) ABSTRACT

Installation and protective devices for fire protection sprinkler assembly having a support cup is disposed about the sprinkler assembly. A protective cap engages the support cup to define an internal volume to enclose the sprinkler therein and protect operational components of the sprinkler during storage, transport, installation and when awaiting to be placed into service. The protective cap defines a tool path with slots of the protective cap in fluid communication with the internal volume. The protective cap and tools are configured to cooperate with one another to permit the tool to adjustably navigate within the internal volume to access the protected sprinkler for installation or adjustment of the sprinkler frame and/or for removing the protective cap.

34 Claims, 9 Drawing Sheets

(56) References Cited

U.S. PATENT DOCUMENTS

| | | | | |
|---|---|---|---|---|
| 4,880,063 | A | 11/1989 | Leininger et al. | |
| 7,055,614 | B1 * | 6/2006 | Ide | A62C 37/14 169/37 |
| 8,794,340 | B2 | 8/2014 | Rekeny | |
| 9,320,929 | B2 | 4/2016 | Koiwa | |
| 9,339,675 | B2 * | 5/2016 | Koiwa | A62C 37/08 |
| 9,463,343 | B2 | 10/2016 | Koiwa | |
| 9,630,039 | B2 | 4/2017 | Koiwa | |
| 2012/0024547 | A1 * | 2/2012 | Orr | A62C 37/09 239/282 |
| 2012/0279730 | A1 | 11/2012 | Hansen | |
| 2013/0306334 | A1 | 11/2013 | Koiwa | |
| 2014/0305663 | A1 | 10/2014 | Rekeny | |
| 2015/0283414 | A1 | 10/2015 | Chen | |
| 2017/0296852 | A1 | 10/2017 | Pipe | |

OTHER PUBLICATIONS

Senju Sprinkler, Technical Datasheet, Commercial Flat Concealed Sprinkler, Pendent, Quick Response, Standard Coverage, Model: RC-QR, K-Factor: 5.6, SIN: SS9561; Doc. No. U036889, Jan. 11, 2019, 7 pp.

Tyco Fire Products LP, Series RFII—5.6 K-factor "Royal Flush II" Concealed Pendent Sprinklers Quick & Standard Response, Standard Coverage, TFP 181, Sep. 2018, 4 pp.

* cited by examiner

PROTECTED FIRE PROTECTION SPRINKLER AND TOOL ASSEMBLIES

PRIORITY DATA AND INCORPORATION BY REFERENCE

This application is a 35 U.S.C. § 371 application of International Application No. PCT/US2021/020497, filed Mar. 2, 2021, which claims the benefit of U.S. Provisional Application No. 62/984,574, filed Mar. 3, 2020, each of which is incorporated by reference in its entirety.

TECHNICAL FIELD

The present invention relates generally to the protection of fire protection sprinklers and more particularly to protected sprinkler assemblies for protecting operational components of the sprinkler and tools for installing and handling of the protected sprinkler assemblies.

BACKGROUND ART

Fire protection sprinklers generally include a sprinkler frame for installation with the inlet of the sprinkler frame connected to a firefighting fluid supply pipe and a fluid deflection member coupled to the frame for distributing firefighting fluid discharged from the sprinkler frame outlet. Automatic fire protection sprinklers include a seal assembly disposed in the frame outlet for controlling the fluid discharge and a thermally responsive trigger arrangement to support the seal and define an unactuated state of the sprinkler. Concealed sprinklers include a cover plate assembly for concealing the installed sprinkler from view.

One particular form of automatic concealed sprinkler is a drop-down flat plate concealed sprinkler. In such an arrangement, the trigger and deflector are concealed between a support cup and the cover plate assembly that is secured to the support cup. The support cup is centered over the sprinkler frame with a corrugated annular wall surrounding the sprinkler frame. The cover plate assembly includes a retainer ring and a cover plate that is secured to the retainer ring by a thermally responsive solder. The retainer ring engages the annular wall of the support cup to secure the cover plate assembly to the support cup and conceal the deflector and trigger component between the support cup and the cover plate assembly. The cover plate supports the deflector in a retracted position. When in the presence of a sufficient level of heat, the cover plate solder fuses, and the cover plate separates from the retainer ring thereby permitting the deflector to drop down and expose the sprinkler trigger for sprinkler operation. One commercial example of such a drop-down concealed sprinkler is the Freedom® Residential Concealed Pendent Sprinkler VK498 (K5.8) from Viking Group, Inc. of Caledonia, Mich. and described in technical data Form F_112817 Rev 20.2 (Jun. 26, 2020). Other examples of drop-down concealed sprinkler are shown and described in U.S. Pat. No. 8,794,340 and U.S. Patent Publication No. 2017/0296852.

The cover plate assembly also conceals the sprinkler assembly tool engagement features of the sprinkler frame thereby making handling and installation of the sprinkler difficult. Accordingly, when installing the sprinkler, the cover plate assembly can be removed to expose the sprinkler frame for tool access. However, by exposing the sprinkler frame for handling, the operational components are also exposed and subject to possible damage. If the installation is completed without damage to the sprinkler, the cover plate assembly is reattached to the support cup. Because the cover plate assembly employs a soldered arrangement, the cover plate alone does not provide the best protection for the deflector and other operational components of the sprinkler when storing, transporting or handling of the sprinkler or when waiting to place the sprinkler into service.

There are known protective devices or caps that are used to protect concealed sprinklers. Example of such protective caps are shown and described in U.S. Pat. Nos. 9,463,343 and 9,630,039. These protective caps remain in place during handling and installation providing tool access even when in place. Moreover, these patent documents describe tools that cooperate with the protective caps to install the protected sprinkler or to remove the protective cap. However, these known protective devices have a complex construction which can make their use difficult or at least make the installation and use of the protected sprinkler cumbersome.

For example, U.S. Pat. No. 9,463,343 shows and describes a protective cap that includes an inner cylinder and outer cylinder that are concentrically joined to one another in a dual wall arrangement. The protective cap is inserted into a cylindrical member or support cup disposed about the sprinkler so that the inner cylinder of the protective cap surrounds the sprinkler. The inner cylinder of the protective cap includes axial extending tongue portions that extend through openings formed in the flat end of the support cup that is disposed over a polygonal tool engagement portion of the sprinkler. The inner and outer cylinders are connected by connecting side surfaces that run axially between the tongues. In order to install the protected sprinkler, an installation tool must be navigated outside the inner cylinder in the space or openings between the inner and outer cylinders, along the tongues and between the side connectors and through the opening of the flat end of the support cup so that the rotation of the tool results in the simultaneous rotation of the protective cap, support cup and the sprinkler. One problem with this dual wall protective cap is the need to adjust and possibly readjust the tool to ensure that the installation tool is properly navigated through openings in each of the cap and the support cup in order to rotate the sprinkler.

Each of U.S. Pat. Nos. 9,463,343 and 9,630,039 describe other protective caps formed as a single wall or cylinder in which the inserted end of the protective cap has axially extending projection portions or tongues that extend through the opening formations in the end of the surrounding sprinkler support cup. U.S. Pat. No. 9,630,039 also describes protective caps in which the inserted end does not engage the openings formed in the end of the support cup and is instead located inside the support cup spaced from the end of the support cup. Regardless of the construction of the insertion end of the protective cap, the opposite or lower end of the protective caps in U.S. Pat. Nos. 9,463,343 and 9,630,039 include radially arranged and angularly spaced holes or openings into which an installation tool is inserted for the simultaneous rotation of the protective cap, the support cup and the sprinkler. In these protective caps, the number and position of the holes in the lower end of the cup correspond to the number and position of the openings formed in the end of the support cup. U.S. Pat. No. 9,630,039 describes the holes in the cap as being a guide for the installation tool to the openings in the support cup in the absence of axially extending projections or tongues at the insertion end. U.S. Pat. No. 9,630,039 further describes using a transparent film to adjust and visually confirm alignment between the holes of the cap and the openings in the support cup, which can add a complexity to the construction and use of the protective cup. Another protective cap shown in U.S. Pat. No. 9,630,039, when affixed about the sprinkler, is spaced radially inwardly from the internal surface of the support cup. The gap between the protective cap and the inner surface of the support cup can expose the inner surface of the support cup to external elements such as, for example, paint spray during installation or construction operations. Paint on the interior of the support cup can interfere with the proper installation and/or operation of a cover plate assembly.

Accordingly, there remains a need for simplified and different configurations of protective devices and tools for the protection, handling, installation, and storage of fire protection sprinklers and in particular, protective devices and tools for the protection of automatic concealed fire protection sprinklers.

DISCLOSURE OF INVENTION

Preferred protective and installation devices provide for a protected fire protection sprinkler assembly. Preferred assemblies include a fire protection sprinkler having a sprinkler frame with a body and a tool engagement portion for coupling to a fluid supply pipe and fluid deflection member coupled to the sprinkler frame. A support cup is disposed about the sprinkler body so as to radially surround the fluid deflection member. The support cup includes an end cap that preferably defines a plurality of apertures. Preferred embodiments of the protected sprinkler assembly include a preferred protective cap to protect the operational components of the sprinkler during storage, transport, installation and when awaiting to be placed into service. The preferred protective cap engages the support cup to enclose the sprinkler components therebetween within a defined internal volume. The protective cap is preferably a tubular member and preferably formed or supported within the interior of the tubular member is an internal baffle that defines the preferred internal volume with the end cap of the support cup. Preferably formed between the internal baffle and an inner surface of the tubular member are one or more slots in fluid communication with the internal volume to define a preferred tool path for the insertion of tools to access tool engagement portions of the sprinkler assembly. In one preferred aspect, the tubular member minimizes or limits the insertion of the protective cap into the support cup so that the inserted end of the cap is located or spaced at a distance from the apertures in the end cap of the support cup. In one particular preferred aspect, the protective cap includes an external shelf to abut the support cup and minimize or limit the insertion of the protective cap. In yet another preferred aspect, the protective cap is formed with a single annular or tubular wall construction.

A preferred protected sprinkler assembly includes a fire protection sprinkler having a frame and a fluid deflector coupled to the frame. The frame includes a body defining an inlet, an outlet and an internal passageway extending along a sprinkler axis from the inlet to the outlet. A support cup having an end cap with a central opening and a plurality of apertures arranged about the central opening is disposed about the body. The support cup includes an open receiving end opposite the end cap to define a cup chamber centered about a central cup axis. The apertures are preferably angularly spaced about the cup axis to define a first arc length about the cup axis between two angularly adjacent spaced apertures. The protected sprinkler assembly includes a preferred protective cap. The protective cap includes a preferred tubular member having a first end, an opposite second end, and an internal baffle spaced from the first end to define a cap chamber centered about a cap axis. The protective cap is engaged with the support cup so as to combine the cup chamber and cap chamber in fluid communication with one another to define an internal volume of the protected sprinkler assembly between the end cap and the internal baffle. The internal baffle preferably defines a plurality of slots in fluid communication with the internal volume to define a preferred tool path therethrough. Each slot in the plurality of slots is preferably arcuate to define a slot length that spans over a second arc length with respect to the cap axis that is greater than the first arc length between the two angularly adjacent spaced apertures of the support cup. In preferred embodiments, each slot of the preferred tool path defines a preferred slot length extending over an arc of over 90 degrees with respect to the cap axis.

Accordingly, a preferred embodiment of a protective cap for a fire protection sprinkler assembly is also provided. The protective cap preferably includes a tubular member for engaging a support cup having an end cap with a central opening centered about a cup axis and a plurality of apertures angularly spaced about the central opening to define an arc length about the cup axis between two angularly spaced adjacent apertures. The tubular member has an inner surface, an outer surface, and a first end and a second end spaced apart from one another along a central cap axis. An internal baffle is formed within the tubular member that is preferably axially spaced from the first end to define a cap chamber with the inner surface centered about the cap axis. The preferred protective cap includes a plurality of slots formed between the internal baffle and the inner surface of the tubular member to define a tool path in fluid communication with an internal volume defined between the tubular member and the support cup. Each slot has a slot length spanning over an arc length with respect to the cup axis that is preferably greater than arc length between angularly adjacent apertures of the support cup. In preferred embodiments, each slot defines a preferred slot length extending over an arc of over 90 degrees with respect to the cap axis.

A preferred method of protecting a sprinkler assembly is also provided in which the sprinkler assembly has a frame, a deflector and a support cup disposed about the frame. The support cup preferably includes an end cap with a central opening centered about a cup axis and disposed about the sprinkler frame. The end cap preferably includes a plurality of apertures angularly spaced about the central opening to define an arc length about the cup axis between two angularly spaced adjacent apertures. The preferred method includes engaging a tubular member with the support cup to define an internal volume between the endcap of the support cup and an internal baffle internal to the tubular member with an inner surface of the tubular member circumscribed about the sprinkler assembly. The preferred method also includes defining a tool path with a plurality of slots formed about the internal baffle. Each slot is in fluid communication with the internal chamber to access a tool engagement portion of the sprinkler assembly during installation of the sprinkler assembly. Moreover, each slot in the plurality of slots has a slot length spanning over an arc length with respect to the cup axis that is greater than the arc length between the angularly adjacent apertures of the plurality of apertures of the support cup.

Preferred embodiments of the sprinkler frame include a body with an external thread and a wrench boss tool engagement portion defined by a periphery formed by several flat surfaces formed below the external thread. In a preferred embodiment of the sprinkler, the tool engagement member includes a driver member disposed about the sprinkler body and secured to the interior of the surrounding support cup. The driver member includes a central opening through which the frame body extends so that the wrench boss engages the central opening. The central opening of the driver member is defined by adjacent flat surfaces that form two or more surface contacts with the wrench boss of the sprinkler body. The driver member also includes a group of blade formations angularly spaced apart from one another around the central opening. The space formed between adjacent blade members defines a tool engagement slot. The driver member is rotationally oriented within the support cup so as to axially align one or more of the tool engagement slots with an aperture of the support cup. In preferred embodiments of the protected sprinkler assembly, by axially spacing the protective cap from the support cup and the driver member, the preferred protective cap avoids interference with the alignment and engagement of tools with the support cup and driver member.

Preferred embodiments of the sprinkler are configured as a drop-down sprinkler for protection in the protected assembly. The preferred sprinkler includes a frame having a pair of spaced apart frame legs extend axially away from the body in which each preferably terminates in a cantilever at a fixed distance from the body. A through bore extends axially through each cantilever to house a pin member laterally outside of the frame leg in a sliding engagement. A fluid deflection member is affixed to the ends of the pin members for axial translation with respect to the sprinkler frame to define a preferred drop-down arrangement. Preferred embodiments of the sprinkler include a fixed trigger boss or apex formed medially inward of the frame arms for seating a thermally responsive trigger along the sprinkler axis to support a seal assembly within the outlet.

Preferred embodiments of the sprinkler assembly provide for a protected concealed sprinkler assembly that includes a surrounding support cup including a wall having an end cap and a receiving end axially spaced from the end cap. One of a preferred protective cap or a cover plate assembly can be engaged with the support cup. A preferred automatic fire protection sprinkler is received within the receiving end of the support cup. The preferred sprinkler includes a fluid deflection member, a seal assembly, and a thermally responsive trigger assembly. The seal assembly is preferably supported in the outlet of the sprinkler body by the thermally responsive trigger assembly which is preferably aligned along the sprinkler axis. The sprinkler frame preferably includes an apex centered along the sprinkler axis to seat the thermally responsive trigger assembly between a pair of spaced apart frame arms diametrically opposed about the outlet. In preferred embodiments, the terminal ends of the frame arms are located at a distance from the outlet that is preferably greater than or equal to the distance of the preferred apex from the outlet. The frame arms also include a pair of extension members that extend laterally inwardly to respectively interconnect the apex and the frame arms and form a frame window therebetween. The sprinkler includes a pair of pins with each pin being housed in one of the through bores of the frame arms in a sliding engagement to define a retracted position and a deployed position of the fluid deflection member of the sprinkler with one of the protective cap or cover plate assembly supporting the fluid deflection member in the retracted position.

A preferred tool for use with the preferred protected sprinkler assemblies includes a sprinkler wrench. The sprinkler wrench includes a base and two or more spaced apart extension members that extend axially from the base. The wrench is inserted into the protected sprinkler assembly along the preferred tool path. The wrench is further inserted axially so that one or more projection members formed at the end of the projection members engage one of the tool engagement portions of the sprinkler and an aperture of the support cup. With the wrench engaged with the driver member, rotation of the wrench can torque the sprinkler frame into a pipe fitting through the surface contact between the frame and the driver member. The interconnection between the support cup and each of the driver member and the protective cap rotates the driver member and the cap with rotation of the engaged wrench.

Other preferred embodiments of a tool configured to cooperate with the protected sprinkler assembly include projections that extend laterally from each of the extension members of the tool. The laterally extending projections are configured to form a preferred engagement notch with the extension member for engaging the preferred internal baffle of the protective cap. The preferred tool can be rotated clockwise or counterclockwise to provide for a bidirectional rotational engagement between the tool and the protective cap. The engagement between the tool and the protective cap locates the tool for removal of the protective cap by either withdrawing the protective cap from the support cup axially or rotationally.

BRIEF DESCRIPTION OF DRAWINGS

The accompanying drawings, which are incorporated herein and constitute part of this specification, illustrate exemplary embodiments of the invention, and together, with the general description given above and the detailed description given below, serve to explain the features of the invention. It should be understood that the preferred embodiments are some examples of the invention as provided by the appended claims.

MODE(S) FOR CARRYING OUT THE INVENTION

Figure 1A:
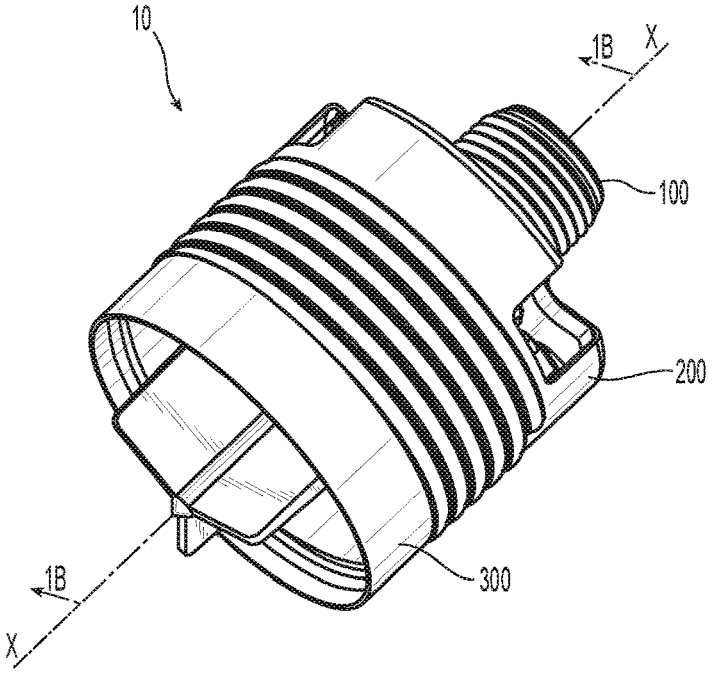
FIG. 1A is a perspective view of a preferred embodiment of a protected sprinkler assembly.

Shown in FIG. 1A is a preferred protected sprinkler assembly 10 for installation. The assembly 10 protects a sprinkler 100 and a surrounding support cup 200 with a preferred removable protective cap 300 engaged with the support cup 200. Generally, the protective cap 300 forms a cooperating engagement with the support cup 200 to envelop operational components of the sprinkler 100 within an internal volume and provide protection against adverse elements and accidental or unintended impact during storage, and handling, including during transport and installation. Moreover, the preferred protected assembly 10 is configured for installation, adjustment, and/or removal of the sprinkler 100 with the protective cap 300 in place to respectively connect, reposition and/or disconnect the protected sprinkler 100 with respect to a fluid supply pipe fitting. Accordingly, the preferred protective cap 300 is configured to cooperate with one or more tools for connecting the sprinkler 100 to, or disconnecting the sprinkler 100 from, a fluid supply pipe fitting. In a preferred aspect, the protective cap 300 defines a preferred tool path through the internal volume of the protected assembly to adjustably access a tool engagement portion of the protected assembly to install or remove the sprinkler 100 from the fluid supply pipe fitting. In addition, the protective cap 300 cooperates with the support cup 200 and a tool(s) in a manner that permits the protective cap to be selectively removed from the assembly 10 in order to place a connected sprinkler in a preferred concealed service arrangement.

Figure 1B:
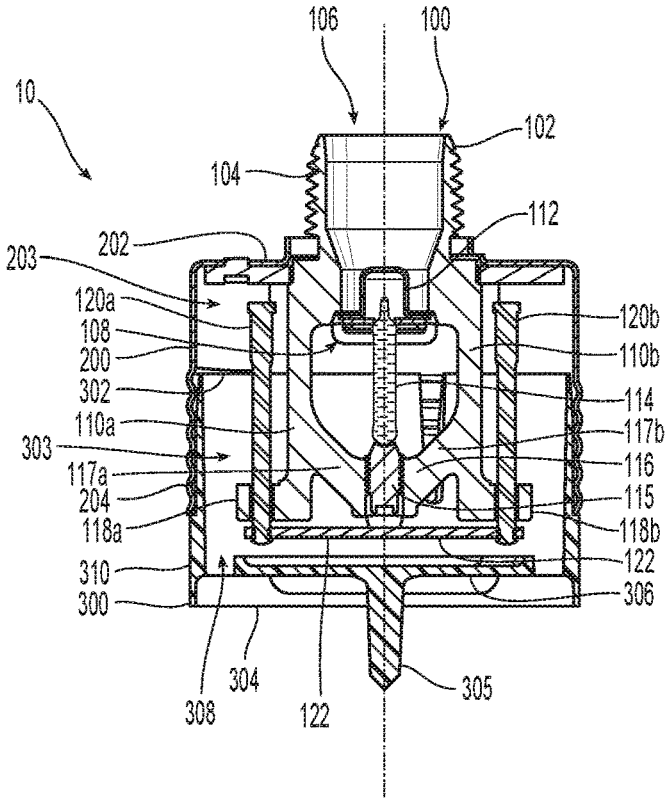
FIG. 1B is a cross-sectional view of the assembly of FIG. 1A.

With reference to FIG. 1B, the sprinkler 100 includes a frame 102 having a body 104 defining an inlet 106, an outlet 108 and an internal passageway extending along a sprinkler axis X-X from the inlet 106 to the outlet 108. The body 104 can include an external thread such as, for example, an external NPT thread for connection to a fluid supply pipe fitting. The frame can also include a pair of spaced apart frame arms 110*a*, 110*b* that are preferably diametrically opposed about the outlet 108 and extend axially away from the frame body 104 and the outlet 108. The sprinkler 100 of the protected sprinkler assembly 10 can be configured as an automatic sprinkler with an appropriate seal and trigger arrangement to control the discharge of firefighting fluid from the frame outlet. Alternatively, the sprinkler can be configured as a normally open sprinkler in which firefighting fluid delivered to the sprinkler inlet is freely discharged outlet. The sprinkler 100 show in FIG. 1B is configured as an automatic sprinkler having, among its operational components, a seal assembly 112 supported in the outlet by a thermally responsive trigger 114 seated between the frame arms 110*a*, 110*b* and preferably aligned along the central sprinkler axis X-X. The trigger 114 is preferably embodied as a thermally responsive fluid filled frangible glass bulb that is thermally rated to rupture at an elevated nominal temperature to release the seal assembly 112 and actuate the sprinkler 100 for distribution of a firefighting fluid. The trigger 114 can be seated on a yoke or similar structure that bridges across the frame arms 110*a*, 110*b*, as seen for example, in U.S. Pat. No. 8,794,340 or U.S. Patent Application Publication No. 2017/0296852. In the embodiment shown, the trigger 114 is seated on a trigger boss or apex 116 formed integrally with the frame arms 110*a*, 110*b* and centrally aligned along the sprinkler axis X-X. A compression screw 115 is threaded into the apex 116 to provide the seat for the bulb and provide a compression force that is transferred to the seal assembly 112 to seal the outlet 108. In the preferred embodiment shown, the frame arms 110*a*, 110*b* include a pair of extension members 117*a*, 117*b* that extend radially inward to respectively form a bridge between the apex 116 and the outer frame arms 110*a*, 110*b*. Moreover, the apex 116 and extension members 117*a*, 117*b* form an interconnection between the frame arms 110*a*, 110*b* that together with the body 104 form a frame window about the trigger 114. In a preferred embodiment of the frame 102, the extension members 117*a*, 117*b* are preferably skewed with respect to the sprinkler axis X-X such that the frame window tapers narrowly in a direction away from the frame body 104.

Another operational component of the sprinkler 100 includes a fluid distribution member coupled to the sprinkler frame for distributing discharged firefighting fluid in a desired pattern for fire protection. The fluid distribution member can be spaced at a fixed distance from the sprinkler outlet 18 or alternatively can be located at a varying distance in a drop-down or sliding arrangement. Shown in FIG. 1B of the assembly 10 is an illustrative embodiment of the sprinkler 100 preferably embodied as a pendent sprinkler with a drop-down deflector fluid distribution member coupled to the sprinkler frame 102 for installation in a concealed arrangement. Alternatively, the sprinkler 100 could be configured as a concealed horizontal sprinkler in which the deflector deploys horizontally in a sliding arrangement parallel to the floor or ceiling. Preferably formed at the terminal end of each frame arm 110*a*, 110*b* is a laterally extending cantilever 118*a*, 118*b*. In preferred embodiments of the sprinkler 100, the terminal ends 118*a*, 118*b* are preferably located at an axial distance from the outlet 108 that is equal to or greater than the axial distance between the outlet 108 and the apex 116. Each cantilever formation 118*a*, 118*b* preferably extends laterally outward with respect to the axially extending frame arm 110*a*, 110*b*. A through bore is formed in each cantilever 118*a*, 118*b* to house a pin 120*a*, 120*b* in a sliding engagement. Affixed to the sliding pins 120*a*, 120*b* is the fluid deflection member 122 to form the preferred operational component of a drop-down arrangement that includes a retracted position as shown in FIG. 1B in which the fluid deflection member 122 is located at first distance from the outlet 108. The drop-down arrangement also defines a deployed position in which the sliding pins locate the fluid deflection member 122 at a maximum distance from the outlet 108. In an installed, service-ready concealed arrangement, the fluid deflection member 122 is supported in its retracted position by a thermally responsive cover plate assembly 500, as seen for example seen in FIG. 7B, secured to the support cup 200. In the preferred embodiment of the sprinkler assembly 100, the through bores are preferably formed radially outside of the frame window. Accordingly, the pins 120*a*, 120*b* are separated from the trigger 114 by the frame arms 110*a*, 110*b* such that the pins 120*a*, 120*b* axially translate outside of the frame window.

Figure 2:
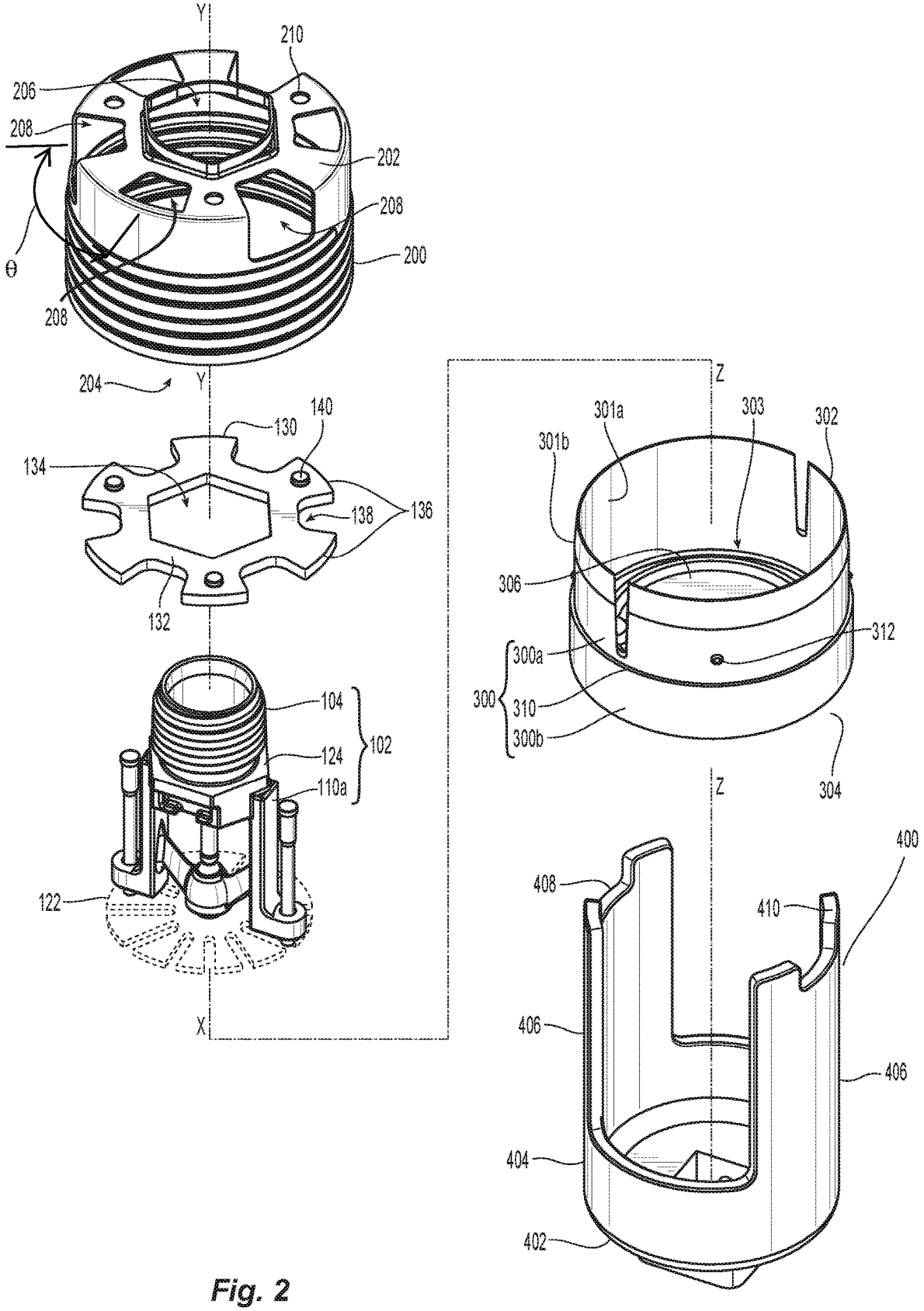
FIG. 2 is an exploded perspective view of a preferred embodiment of a tool used with the assembly of FIG. 1A.

Referring to FIGS. 1A, 1B and 2, portions of the sprinkler frame 102, operational components of the sprinkler 100, including the deflector member 122, are enclosed within an internal volume between the support cup 200 and the preferred protective cap 300. The support cup 200 is a generally cylindrical member that includes an end cap 202 and an open receiving end 204 opposite the end cap 202 to define a cup chamber 203 centered about a central cup axis Y-Y. The end cap 202 includes a central opening 206 that, with the open receiving end 204 of the cup 200, coaxially receives the sprinkler 100. Upon receipt of the sprinkler 100, the end cap 202 is disposed about the sprinkler body such that the cup 200 and its open receiving end 204 circumscribe the frame arms 110*a*, 110*b* and fluid deflection member 122 with the cup axis Y-Y coaxially aligned with the sprinkler axis X-X. In addition to the central opening 206, the end cap 202 preferably includes a group of apertures 208 arranged around the central opening 206 and more preferably radially disposed and angularly arranged about the cup axis Y-Y to provide visual access, access for tool and/or access for heat flow through the cup and sprinkler assembly. In preferred embodiments of the support cup 200, the apertures 208 are angularly spaced about the cup axis Y-Y to define an arc length θ about the cup axis Y-Y between two angularly adjacent spaced apertures 208. The preferred arc length θ can be defined by any respective spaced apart portions of the adjacent apertures 208. For example, the preferred arc length θ can be defined by the spaced apart centers of the adjacent apertures 208, as shown, or the preferred arc length θ can be defined by the spaced apart corresponding lateral edges of the adjacent apertures 208. One or more of the apertures 208 may be located exclusively on the end cap 202 or alternatively extend and wrap over into the wall structure of the support cup 200 proximate the end cap 202. The wall structure of the support cup 200 is preferably corrugated with alternating ridges and grooves for engaging and supporting either the protective cap 300, as described herein, or a cover plate assembly in order to enclose the operational components of the sprinkler 100 therebetween.

Referring again to FIGS. 1A, 1B, 2, and 3A-3D, the preferred protective cap is generally a tubular member 300 with an inner surface 301*a* and an outer surface 302*b* centered about a central cap axis Z-Z. The tubular member 300 has a first end 302, a second end 304 with an internal baffle 306 formed or supported within the tubular member 300. The internal baffle 306 is axially spaced from the first end 302 and more preferably formed between the first and the second ends 302, 304 to define a cap chamber 303 centered about the cap axis Z-Z for housing and protecting the sprinkler 100 or at least a portion thereof. The internal baffle 306 preferably defines one or more internal slots 308 in fluid communication with the chamber 303 and more preferably defines the internal slot(s) 308 between the internal baffle 306 and the inner wall or surface 301*a* of the protective tubular cap member 300. Preferred embodiments of the cap 300 preferably include a pair of slots 308 formed about the internal baffle 306 and the central cup axis Z-Z. With particular reference to FIG. 1B, in the protected sprinkler assembly 10, the protective cap 300 is engaged with the support cup 200 with a portion of the cap disposed inside the support cup 200 and axially spaced from the end cap 202 of the support cup 200. More particularly, the first end 302 of the tubular member 300 is disposed inside the support cup 200 and preferably axially spaced from the apertures 208 of the end cap 202. The preferred engagement between the support cup 200 and the protective cap combine their respective chambers 203, 303 to be in fluid communication with one another and define an internal volume of the assembly 10 between the end cap 202 of the support cup 200 and the internal baffle 306 of the protective cap 300 to enclose the operational components of the sprinkler 100.

Moreover, the preferred slot(s) 308 defined by the internal baffle 306, being in fluid communication with the chamber 303, are also in fluid communication with the internal volume of the assembly 10 to define a preferred tool path in which an inserted tool can be adjusted within the tool cap to access tool engagement elements of the assembly 10. Accordingly, a tool axially inserted through the slot(s) 308 can extend through the internal volume of the assembly 10; and within the internal volume, the tool can be adjusted or manipulated without unnecessarily rotating or adjusting the cap 300 to access tool engagement elements of the assembly 10. More preferably, a tool inserted through the slots 308 can be navigated within the internal volume of the assembly 10 to engage tool engagement elements of the assembly 10 and preferably extend through the apertures 208 of the support cup 200. In preferred embodiments, the slot(s) 308 of the protective cap 300 are preferably arcuate, each defining a slot length spanning an arc length β about the central cap axis Z-Z, as seen for example in FIG. 3B, that is preferably greater than the arc length θ defined between two adjacent apertures 208 of the support cup 200. In a preferred configuration of the internal slots 308, each of the preferred slot(s) 308 has a preferred slot length spanning over an arc β of over 90 degrees with respect to the central cap axis Z-Z, preferably spanning over 120 degrees, preferably ranging between over 120 degrees and 180 degrees, and even more preferably ranging between 160-180 degrees.

The outer surface 301*b* of the tubular cap 300 is preferably configured to ensure and confirm full engagement between the support cup 200 and the protective cap 300. In preferred embodiments, the cap 300 includes a peripheral or external shelf 310, as seen in FIG. 2, formed along the outer surface 301*b* of the tubular member. In the preferred assembly 10, the cap 300 is inserted into the support cup 200 until the external shelf 310 abuts the open receiving end 204 of the support cup 200 to prevent further advancement and preferably locate the first end 302 of the cap 300 at the preferred fixed distance from the apertures 208 in the end cap 202 of the support cup 200. Accordingly, the cap 300 is preferably configured to locate the internal baffle 306 with respect to first end 302 and the end cap 202 of the support cup 200 to define the preferred internal volume of the assembly 10 to house and protect operational components of the sprinkler 100 from accidental impact and damage. The shelf 310 preferably divides the protective cap 300 into an insertion end portion 300*a* that is located within the support cup 200 and an external shielding end portion 300*b* that extends below the support cup 200 proximate the receiving end 204 of the cup. The shielding portion 300*b* alone or in combination with the internal baffle 306 shield and protects the sprinkler 100 and the internal surfaces of the support cup 200 from accidental impact or external elements such as for example, paint spray. The shielding end portion 300*b* at least partially circumscribes the central cap axis Z-Z and in some embodiments, preferably completely circumscribes the central axis Z-Z as shown. The insertion end portion 300*a* preferably extends sufficiently into the support cup to circumscribe the fluid deflection member 122 and at least a portion of the frame arms 110*a*, 110*b*.

Figure 3A:
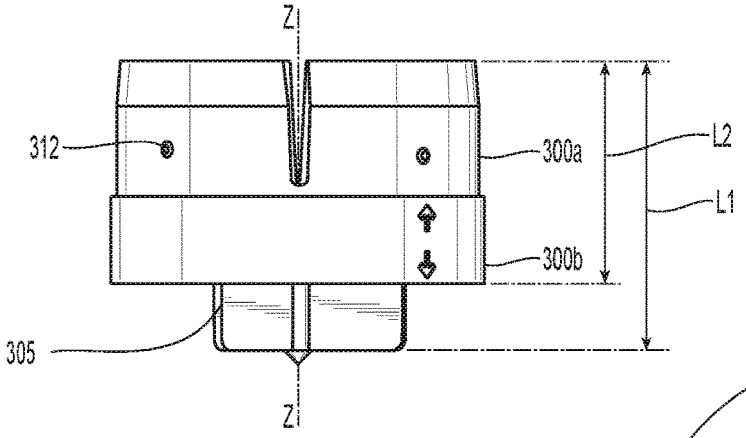
FIGS. 3A-3D are various views of a preferred embodiment of a protective cap for use in the assembly of FIG. 1A.

To facilitate handling of the cap 300 the internal baffle 306 preferably includes an external handle portion 305 that extends axially through the shielding end portion 300*b*. With particular reference to FIG. 3A, in preferred embodiments of the cap 300, the handle portion 305 extends axially below, beyond or outside the shielding end portion 300*b*. In such preferred embodiments where the cap 300 defines a total length L1, the first and second ends 302, 304 of the cap 300 define a wall length L2 therebetween. Preferably, the wall length L2 is at least 50% of the total cap length L1, more preferably 75% or more of total cap length to define a preferred ratio of cap length-to-wall length (L1:L2) of 1.3:1. The handle portion 305 facilitates manipulation of the cap 300 into engagement with the support cup 200. Moreover, preferred embodiments removal of the cap 300 from the support cup 200 and with a sufficient portion of the handle 305 exposed outside of the cap wall, the cap 300 can be removed may be removed from the support cup 200 without use of a removal tool as described herein.

The outer surface 301*b* of the protective cap 300 at the insertion end portion 300*a* also preferably forms an interference engagement with the inner surface of the support cup 200 to maintain the engagement between the support cup 200 and protective cap 300 during storage, shipping, handling, installation of the sprinkler 100 and when waiting to be put the sprinkler into service. Preferred embodiments of the protective cap 300 include one or more projections 312 that engage the preferably corrugated wall of the support cup 200. In a preferred embodiment, a plurality of projections 312 is helically arranged along the outer surface 301*b* of the insertion end portion 300*a* for engaging the corrugated inner surface of the support cup 200.

Preferred embodiments of the protective cap 300 provide a simplified construction as compared to some prior art sprinkler covers or caps. With reference to FIGS. 2 and FIGS. 3A-3D, preferred embodiments of the cap are of unitary construction formed from a plastic. A preferred embodiment of the tubular protective cap 300 is constructed such that the insertion end portion 300*a* consists of a single wall at least partially circumscribed about the central axis Z-Z that forms the preferred inner surface 301*a* and outer surface 301*b* of the protective cap 300. The single wall construction of the insertion end preferably facilitates its insertion and removal from the protected sprinkler assembly. In a preferred aspect, the single wall of the insertion end portion 300*a* of the protective cap tapers narrowly in an axial direction away from the shielding end portion 300*b*. Alternatively or additionally, the insertion end portion 300*a* includes a plurality of cut outs or notches 313 that extend preferably axially from the insertion end portion 300*a* of the cap 300 toward the shielding end portion 300*b*.

Figure 3B:
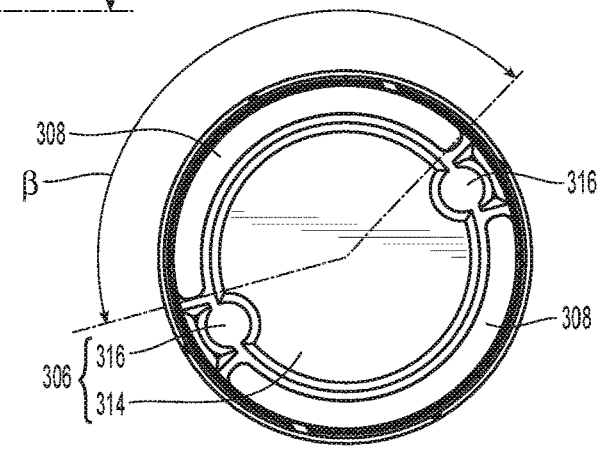
Figure 3C:
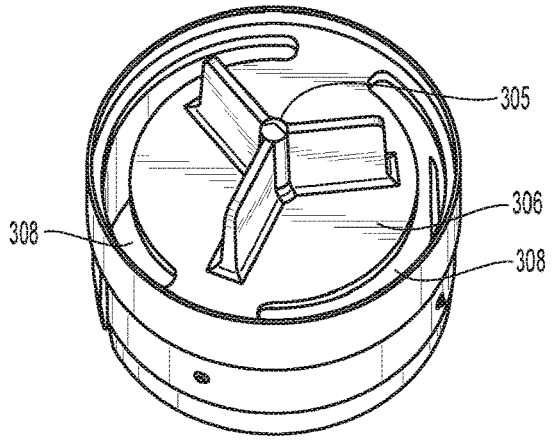
Figure 3D:
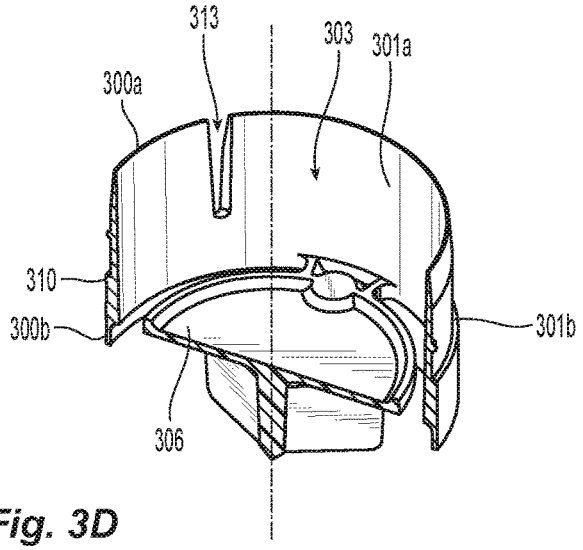

In preferred embodiments with reference to FIG. 3B, the internal baffle 306 includes a central disc 314 and a pair of connectors 316 diametrically opposed about the central disc 314 to interconnect the central disc 314 to the inner surface 301*a* of the protective cap wall with the slots 308 formed about the central disc 314 and extending between the connectors 316. In a preferred configuration of the slots 308, the plurality of slots 308 include a pair of arcuate slots opposed about the central axis Z-Z that each have a slot length extending or spanning over an arc β of over 90 degrees, preferably over 120 degrees, preferably ranging between over 120 degrees and 180 degrees, and even more preferably between 160-180 degrees.

Figure 4A:
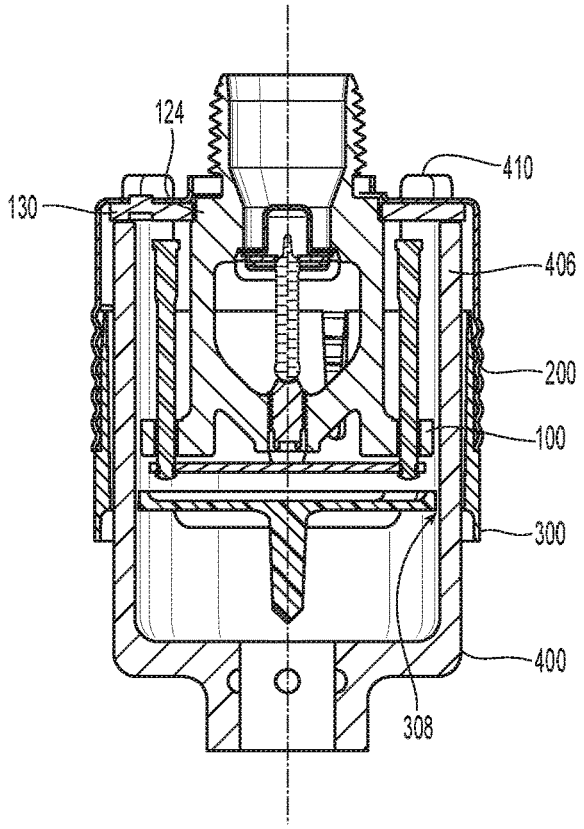
FIGS. 4A-4B are various cross-sectional views of the sprinkler assembly and tool of FIG. 2.
Figure 4B:
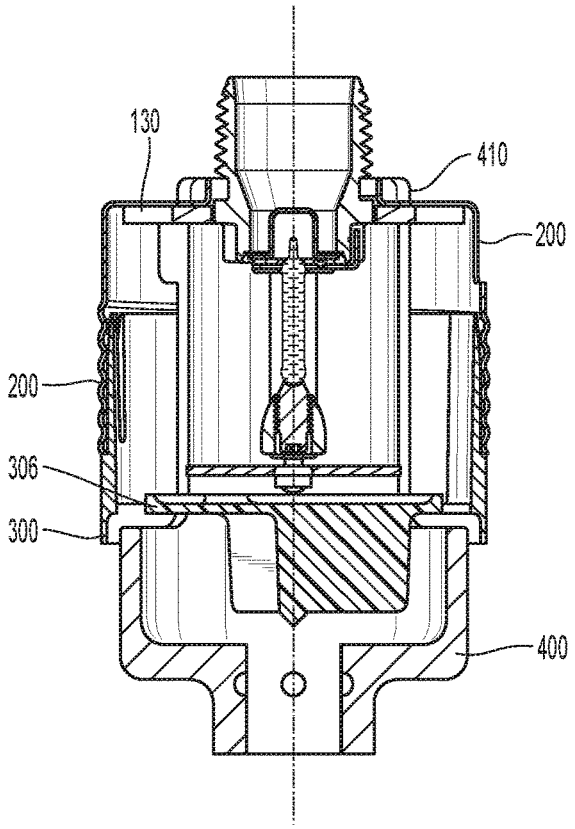

The protective cap 300 facilitates installation of the sprinkler 100 by remaining in place to protect the operational components of the sprinkler 100 while permitting access of associated tools to couple to or decouple the sprinkler from fluid supply piping and remove the cap 300 to place the sprinkler 100 into service. Illustrated in FIGS. 4A-4B is a tool 400 that is inserted into the protected assembly 10 through the internal slots 308 of the protective cap 300 along the preferred defined tool path to access tool engagement portions 124, 130 of the sprinkler 100. The inserted tool 400 extends into the preferred internal volume between the sprinkler 100 and the protective cap 300 to access or engage the tool engagement portions 124, 130 and preferably extend through the end cap 202 of the support cup 200. With reference to FIG. 2, the frame 102 includes a tool engagement portion 124 disposed or formed about the frame body between the body 104 and the frame arms 110*a*, 110*b*. The tool engagement portion 124 includes two or more flat surfaces for engagement by a tool, such as for example, a sprinkler wrench. More preferably, the tool engagement portion 124 includes a driver member 130 disposed about the sprinkler body 104 and the flats of the tool engagement portion 124 for engagement by the sprinkler wrench or other tool to connect or disconnect the sprinkler 100 from a fluid supply pipe.

The driver member 130 preferably includes a disc member 132 with a central collar or opening 134 having internal flats for surface engagement with the flat surfaces of the sprinkler frame body 104. The driver member 130 further includes a plurality of spaced apart fins 136 extending radially from the central collar 134 to define tool engagement slots 138 therebetween. An appropriate tool, such as for example a sprinkler wrench, can engage the slots 138 of the driver member 130 to apply a torque to the sprinkler 100 to connect or disconnect the sprinkler 100 from a fluid supply pipe. Axial extending projections or nubs 140 of the driver member are received in corresponding axially aligned receiving openings 210 of the support cup 200 to interlock the support cup 200 with the driver member 130 and align the tool engagement slots 138 of the driver member 130 with the apertures 208 of the end cap 202 of the support cup 200. Accordingly, rotation of the driver member 130 with an appropriate tool engaged in the tool engagement slots 138 of the driver member 130 will rotate the support cup 200 and the engaged protection cap 300.

The preferred constructions of the protective cap 300 and its engagement with the support cup facilitate easy insertion and manipulation of tools into the protected sprinkler assembly 10. Unlike known sprinkler protection caps, the preferred cap 300 and its inserted end 302 is axially spaced from the apertures 208 of the end cap 202 of the support cup 200 thereby avoiding alignment and interference problems between the components when inserting installation tools into the assembly 10. Moreover, the preferred internal slot 308 configurations of the protective cap provide flexibility in rotating tools within the protected assembly 10 to facilitate either sprinkler installation or removal of the protective cap 300. In the preferred embodiments of the cap 300 having the preferred arcuate slots 308 and arc lengths as previously described, each individual slot 308 preferably axially overlaps and/or aligns with more than one adjacent tool engagement slots 138 of the driver member 130 and/or more than one aperture 208 in the support cup 200. Accordingly, each individual slot 308 preferably axially overlaps and/or aligns with at least two adjacent tool engagement slots 138 or fractions thereof of the driver member 130 and/or at least two apertures 208 or fractions thereof in the support cup 200. In other preferred embodiments, each individual slot 308 preferably axially overlaps and/or aligns with more than two adjacent tool engagement slots 138. or fractions thereof, of the driver member 130 and/or more than two apertures 208, or fractions thereof, in the support cup 200. The preferred axial overlap and/or alignment of slots 308 and apertures 138, 208 can provide additional flexibility in which to navigate the tool 400.

With reference to FIG. 2, shown is one preferred embodiment of the tool 400 configured as sprinkler wrench. The tool has a first end 402 forming a base 404 and a group of spaced apart extension members 406 extending axially from the base 404 about the central axis to form the opposite second end 408. The base 404 of the tool 400 and alternate embodiments thereof can be configured to receive a handle (not shown) for applying a force to the tool. More preferably, the tool 400 includes a pair of extension members 406 opposed about the base 404. In use, the tool 400 is inserted through the shielding end portion 300*b* of the protective cap 300 so that each extension member 406 extends through one slot of the protective cap slots 308 and along the preferred tool path. Moreover, each extension member 406 defines a width that is preferably less than the slot length of the protective cap slots 308 to permit rotation of the tool 400 with respect to the protective cap 300. The extension members 406 are preferably arcuate about coaxially aligned central axes with the protective cap 300. Accordingly, where the slots 308 of the protective cap is defined by a first arc length, the width of each extension member 406 defines a preferred second arc length that is less than the first arc length. In a particular preferred embodiment, the second arc length defined by the extension members 406 is at least 60% of the first arc length of the protective cap slots 308. Preferred embodiments of the tool 400 include one or more projections 410 protruding axially from the end of each extension member 406. The projection 410 is preferably sized and configured to engage the tool engagement slots 138 of the preferred driver member 130 previously described for rotation of the protected assembly 10 during installation or decoupling of the assembly 10 from a pipe fitting. In preferred embodiments, two projections 410 of each extension member 406 are preferably configured and spaced to correspondingly engage two angularly adjacent spaced tool engagement slots 138 of the driver member 130, as illustrated in FIGS. 4A and 4B. Moreover, the two projections 410 of each extension member 406 are preferably configured and spaced to correspondingly engage two angularly adjacent spaced apertures 208 of the support cup 200. By configuring the protective cap slots 308 with the preferred arc lengths, the tool 400 can be adjusted, including rotatably adjusted, within the protective cap 300 to properly locate and engage the driver member 130 without unnecessarily rotating the protective cap 300 itself.

Figure 5A:
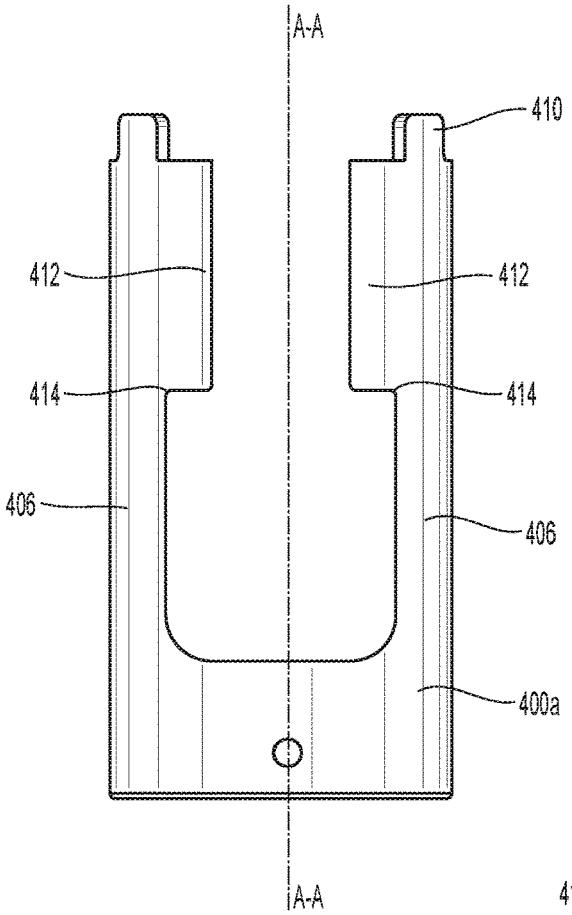
FIGS. 5A-5C are various views of another preferred embodiment of a tool for use with the assembly of FIG. 1A.
Figure 5B:
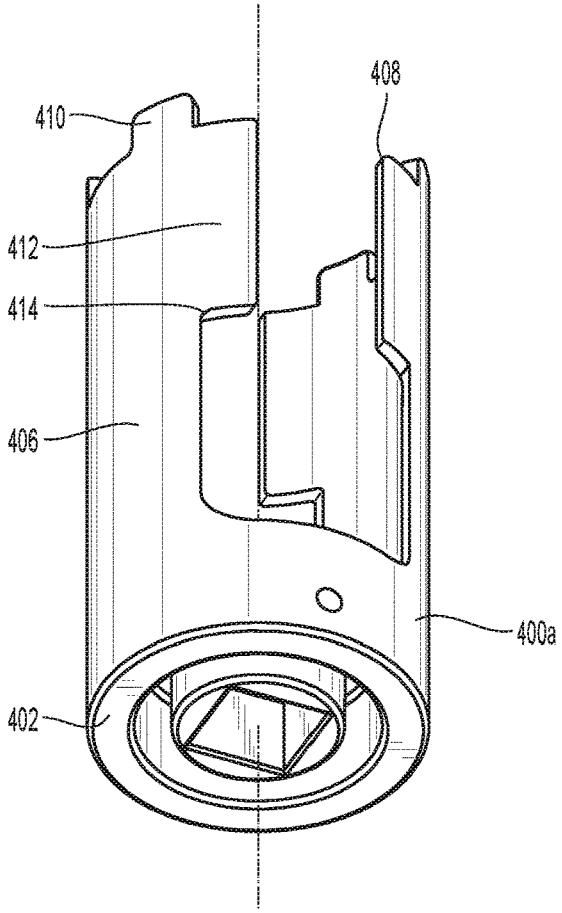
Figure 5C:
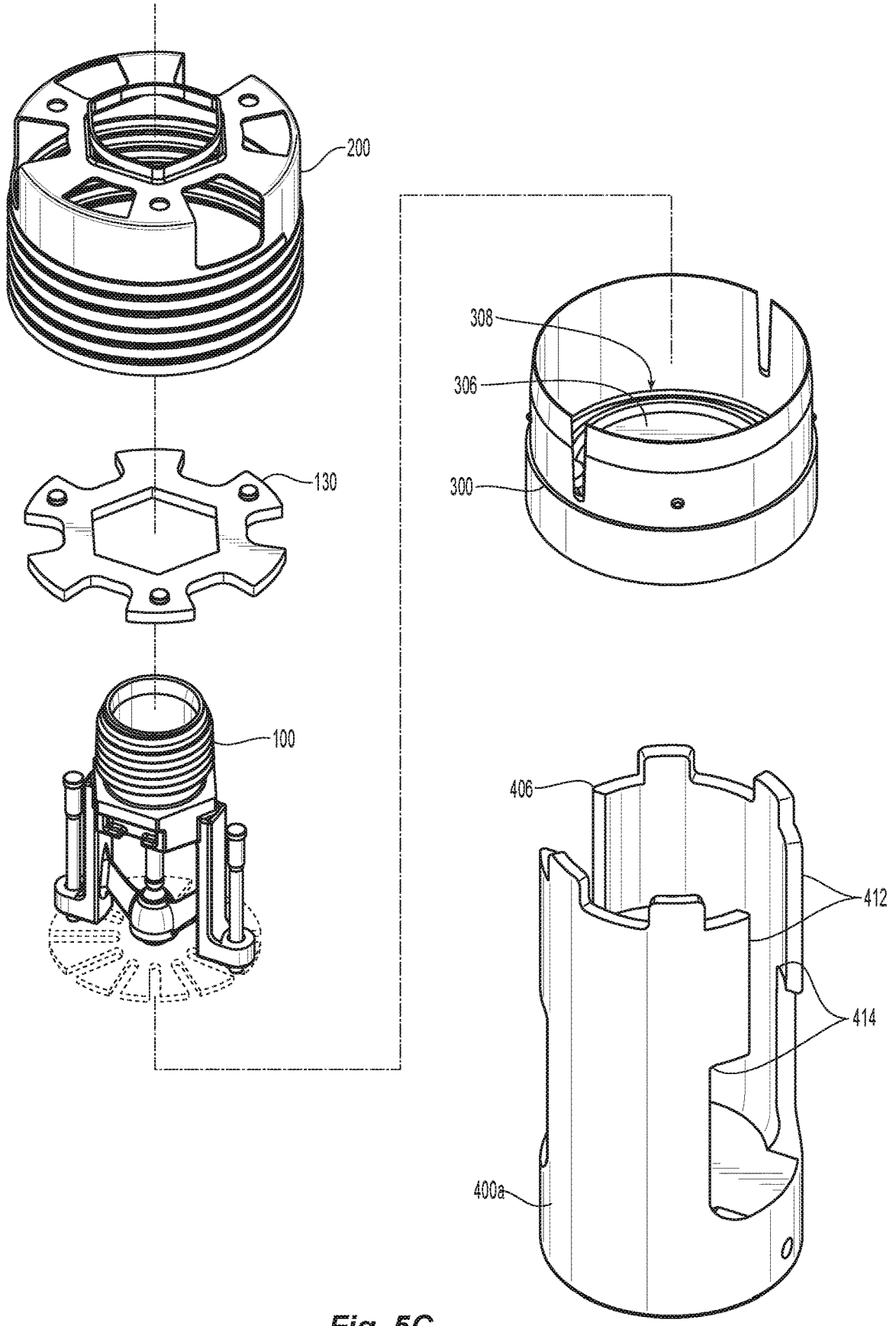

Alternatively or additionally, the tool 400 and its extension members 406 can be configured with projections for engaging any one of the internal baffle 306, the tool engagement portion 124, 130 of the sprinkler 100, or the end cap 202 of the support cup 200. Shown in FIGS. 5A and 5B is an alternative embodiment of the tool 400*a* that provides for a surface engagement with the protective cap 300 to remove the cap from the assembly 10. The tool 400*a* includes laterally extending projections 412 that extend off to each side of the extension members 406 to form a preferred engagement notch 414 therebetween. The laterally extending projections 412 can define any geometry provided it can provide an adjacent edge to the extension members 406 to form a notch 414 for engaging the internal baffle 306 of the protective cap 300. With reference to FIGS. 3B and 5C, with the extension members 406 extending through the slots 308, the tool can be rotated about the central sprinkler axis to bring the engagement notch 414 into contact with the internal baffle 306 of the protective cap 300 and its connector 316. With the laterally extending projections 412 located over the baffle 306 of the protective cap, the tool 400*a* can be pulled axially alone or in combination with a rotational motion to remove the protective cap 300 from the protective assembly 10. In the preferred embodiments of the tool 400*a* with laterally extending projections 412 on each side of the extension members 406, the tool 400 can be rotated clockwise or counterclockwise, i.e., bidirectionally, to engage the baffle 306 within the protective cap 300.

Figure 6A:
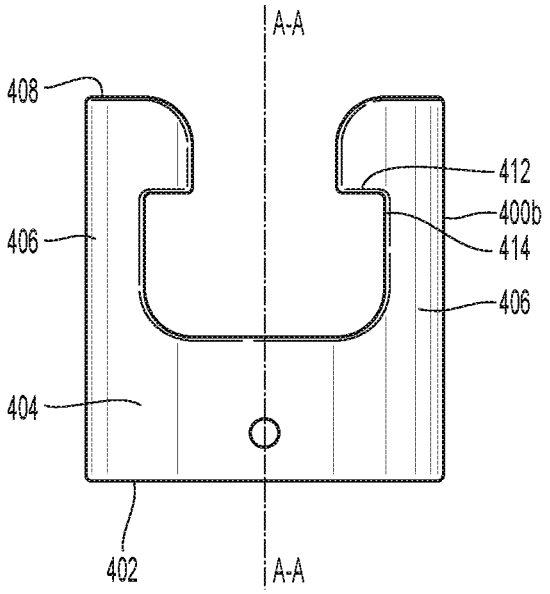
FIGS. 6A-6C are various views of another preferred embodiment of a tool for use with the assembly of FIG. 1A.
Figure 6B:
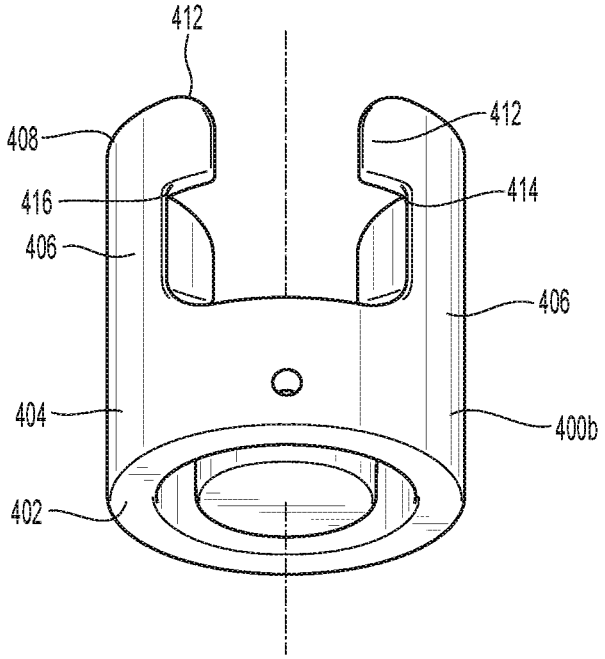
Figure 6C:
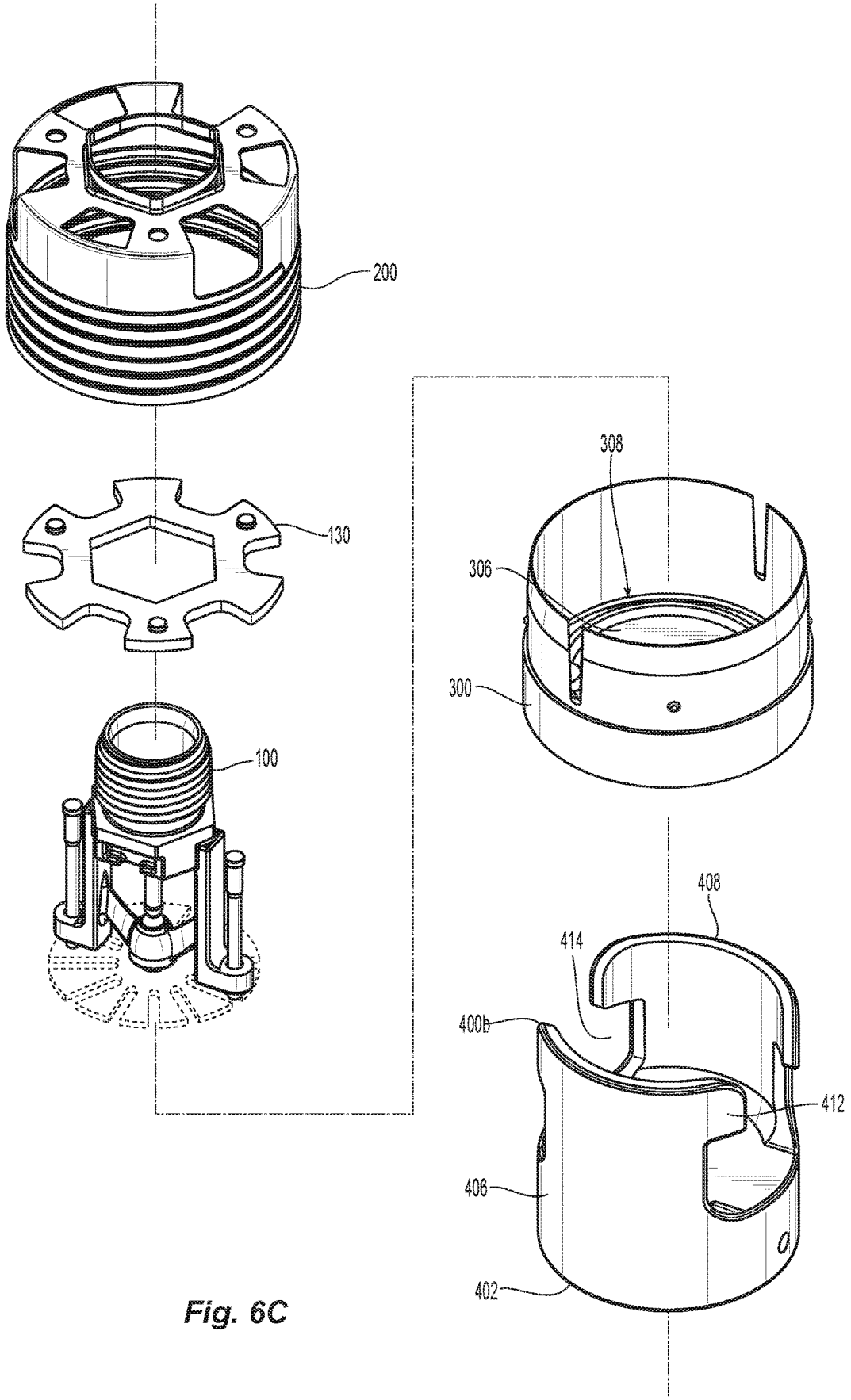

The embodiments of the tool 400 shown in FIGS. 2, 4A-4B and 5A-5C, can be used to remove the protective cap 300 and/or connect the protected sprinkler assembly 10 to a fluid supply pipe. Shown in an FIGS. 6A-6C is another alternate embodiment of the tool 400*b* that is configured exclusively for removing the protective cap 300. The tool 400*b* only includes laterally extending projections 412 to form the preferred notches 414, 416 for engaging the baffle 306 of the preferred protective cap 300. The embodiment of the tool 400*b* shown in shown in FIG. 6C, defines a preferred height so that its engagement notches 414, 416 engage the baffle 306 but not the end cap 202 of the support cup 200. Accordingly, when the extension members 406 are inserted into the protected assembly 10, the end 408 of the tool 400*b* is located between the end cap 202 of the support cup 200 and the baffle 306 of the protective cap 300.

Figure 7A:
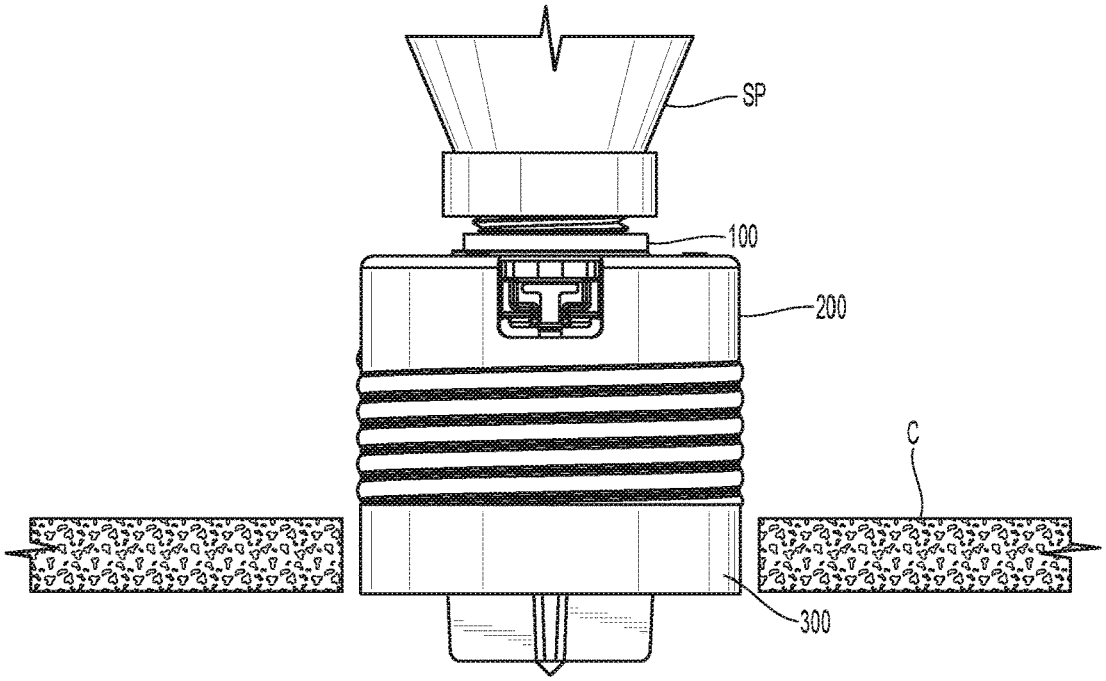
FIG. 7A is an installed elevation view of the assembly of FIG. 1A.
Figure 7B:
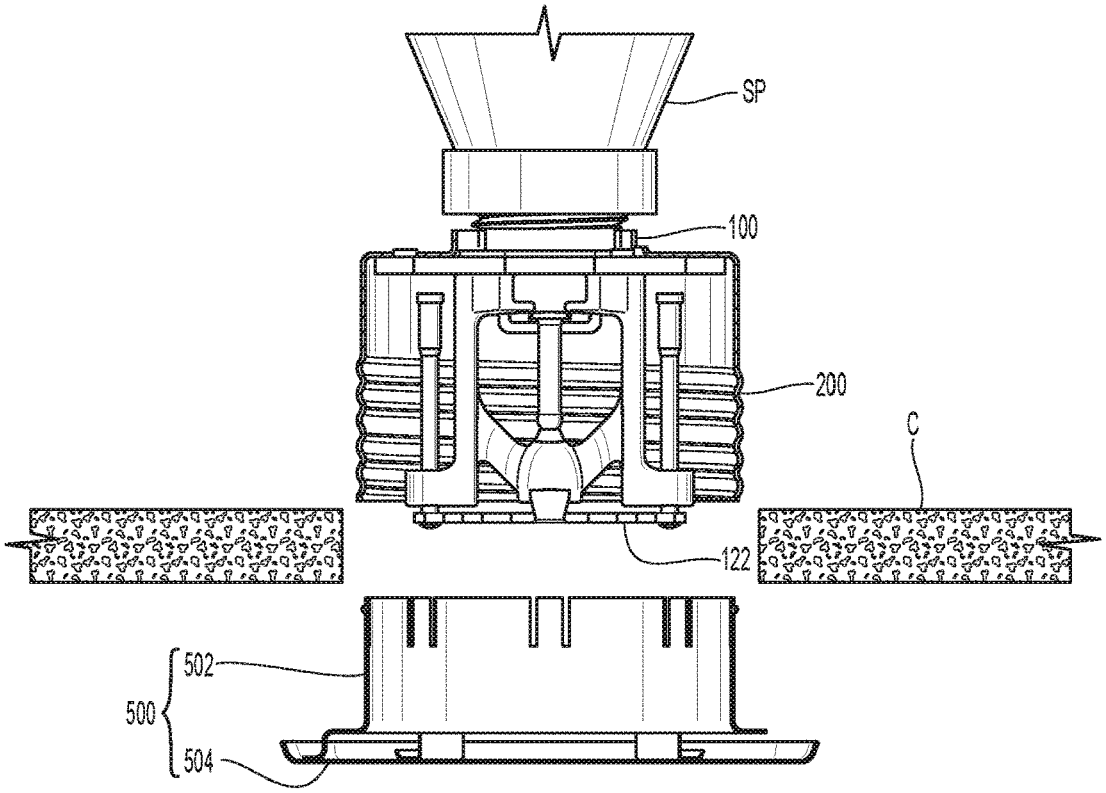
FIG. 7B is an exploded installed elevation partial cross-sectional view of the sprinkler used in the assembly of FIG. 1A ready for service as a concealed sprinkler.

Schematically shown in FIG. 7A is the protected sprinkler 10 installed within a through hole of a ceiling C with the sprinkler frame 102 coupled to a fluid supply pipe fitting SP and the protective cap 300 extending below the ceiling C. As described herein, the sprinkler 100 can be coupled to a fluid supply pipe using an installation tool 400 with the protective cap 300 remaining in place. Moreover, the protective cap 300 can remain in place while the sprinkler 100 awaits to be placed into service. Shown in the exploded view of FIG. 7B is the connected sprinkler 100 in a concealed arrangement. With the protective cap 300 removed using, for example the tool 400*a*, 400*b*, the fluid deflection member 122 is supported in a retracted position by a thermally responsive cover plate assembly 500 secured to the support cup 200. The cover plate assembly 500 preferably includes a retainer ring 502 having a flange for mounting against the ceiling C. A cover plate 504 is connected to the retainer ring 502 using a thermally responsive soldered connection. In the presence of a sufficient level of heat, the cover plate 504 falls away from the sprinkler removing its support of the fluid deflection member 122 and letting it fall to its fully deployed operational position.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A protected sprinkler assembly comprising:

a fire protection sprinkler including a frame and a fluid deflector coupled to the frame, the frame having a body defining an inlet, an outlet and an internal passageway extending along a sprinkler axis from the inlet to the outlet;

a support cup having an end cap with a central opening disposed about the body and a plurality of apertures radially arranged about the central opening with the support cup including an open receiving end opposite the end cap to define a cup chamber centered about a central cup axis, the plurality of apertures being angularly spaced about the cup axis to define a first arc length about the cup axis between two angularly adjacent spaced apertures; and a protective cap including a tubular member having a first end, an opposite second end, and an internal baffle supported within the tubular member and spaced from the first end to define a cap chamber centered about a cap axis, the protective cap being engaged with the support cup to define an internal volume of the sprinkler assembly between the end cap and the internal baffle, the internal baffle defining a plurality of slots in fluid communication with the internal volume to define a tool path therethrough, each slot in the plurality of slots defining a slot length spanning a second arc length about the cap axis that is greater than the first arc length between the two angularly adjacent apertures of the plurality of apertures of the support cup.

2. The assembly of claim 1, wherein the protective cap engages the support cup to locate the first end of the tubular member inside the support cup at a fixed distance from the plurality of apertures of the end cap.

3. The assembly of claim 1, wherein the tubular member includes an external shelf between the first end and the second end that is in abutment with the receiving end of the support cup.

4. The assembly of claim 3, wherein the tubular member defines an insertion end portion that includes the first end and an opposite shielding end portion of the cap that includes the second end, the insertion end portion and the shielding end portion being separated from one another by the external shelf, the insertion end portion being defined by a single wall at least partially circumscribed about the cap axis.

5. The assembly of claim 4, wherein the shielding end portion at least partially circumscribes the cap axis.

6. The assembly of claim 5, wherein the internal baffle is located between the first end and the second end of tubular member.

7. The assembly of claim 4, wherein an outer surface of the single wall insertion end portion of the protective cap is engaged with an inner surface of the support cup wherein the support cup includes an internal helical thread and the outer surface of the single wall of the insertion end portion includes a plurality of projections helically arranged for engaging the internal helical thread, the single wall of the insertion end portion tapering narrowly in an axial direction away from the shielding end portion and the single wall insertion end portion includes a plurality of notches that extend axially from the insertion end portion to the shielding end portion.

8. The assembly of claim 4, wherein the plurality of slots include a pair of slots and wherein the second arc length extends over 90 degrees with respect to the cap axis.

9. The assembly of claim 8, wherein the internal baffle includes a central disc and a pair of connectors diametrically opposed about the central disc to interconnect the central disc to an inner surface of the single wall with the slots extending between the connectors.

10. The assembly of claim 1, wherein the internal baffle includes a central disc and a pair of connectors diametrically opposed about the central disc to interconnect the central disc to an inner surface of the tubular member with the plurality of slots extending between the pair of connectors.

11. The assembly of claim 1, wherein the internal baffle includes a central handle extending axially beyond the second end to define a total length of the protective cap, the tubular member having an axial length being at least 50% of the total length of the protective cap.

12. The assembly of claim 1, wherein the frame includes a pair of frame arms and a tool engagement portion between the body and the frame arms; the fluid deflector being in a sliding pinned engagement with the pair of frame arms, the fluid deflector being coaxially aligned along the sprinkler axis; the fire protection sprinkler being an automatic sprinkler having a seal assembly disposed within the outlet; and a thermally responsive trigger disposed between the outlet and the deflector to support the seal assembly within the outlet.

13. The assembly of claim 12, further comprising an apex centered along the sprinkler axis and axially spaced from the outlet at a first distance to seat the thermally responsive trigger assembly, the pair of frame arms being diametrically opposed about the outlet with the thermally responsive trigger assembly seated between the frame arms, each frame arm having a terminal end axially spaced from the outlet at a second distance equal to or greater than the first distance, each terminal end being formed as a laterally outwardly extending cantilever with a through bore formed therein, the frame arms also including a pair of extension members that extend laterally inwardly to respectively interconnect the apex and the frame arms and form a frame window therebetween.

14. The assembly of claim 13, wherein the plurality of apertures of the support cup extend from the end cap and into a wall of the support cup.

15. The assembly of claim 13, further comprising a tool engaged with the protective cap, the tool having a base forming a first end of the tool and a pair of spaced apart extension members extending axially from the base, the tool being inserted through the second end of the tubular member so that each extension member extends through one slot of the plurality of slots, each extension member including a projection for engaging at least one of the internal baffle, the tool engagement portion of the sprinkler frame, or the end cap of the support cup.

16. The assembly of claim 15, wherein the tool engagement portion includes a disc member with a central collar having internal flats for surface engagement with the body of the frame, the disc member including a plurality of spaced apart fins defining tool engagement slots therebetween axially aligned with the apertures of the support cup, each slot in the plurality of slots of the cap axially overlapping more than one tool engagement slot.

17. The assembly of claim 16, wherein the tool includes a plurality of projections extending laterally about the extension members to form a notch therebetween, rotation of the tool with respect to the tubular member engages the tool with the internal baffle of the tubular member for axial removal of the protective cap from the support cup.

18. A protective cap for a fire protection sprinkler assembly having a sprinkler frame, a fluid deflection member and a support cup having an end cap with a central opening centered about a cup axis and disposed about the sprinkler frame, the end cap including a plurality of apertures angularly spaced about the central opening to define an arc length about the cup axis between two angularly adjacent spaced apertures, the protective cap comprising:

a tubular member for engaging the support cup, the tubular member having an inner surface, an outer surface, a first end and a second end spaced apart from one another along a cap axis;

an internal baffle formed within the tubular member, the internal baffle being axially spaced from the first end to define a cap chamber with the inner surface and centered about the cap axis; and a plurality of slots formed between the internal baffle and the inner surface of the tubular member, each slot in the plurality of slots being in fluid communication with the cap chamber so as to define a tool path in fluid communication with an internal volume defined between the tubular member and the support cup, each slot in the plurality of slots having a slot length spanning over an arc length with respect to the cup axis that is greater than the arc length between the two angularly adjacent spaced apertures of the end cap.

19. The protective cap of claim 18, wherein the support cup includes the end cap with the central opening disposed about the frame and the plurality of apertures about the central opening and an open receiving end opposite the end cap, wherein when the tubular member is inserted in the open receiving end of the support cup, the outer surface of the tubular member engaging the support cup so as to locate the first end of the tubular member inside the support cup at a fixed distance from the apertures of the end cap of the support cup.

20. The protective cap of claim 18, wherein the tubular member includes an insertion end portion and a shielding end portion, the insertion end portion including the first end and being defined by a single wall at least partially circumscribed about the cap axis.

21. The protective cap of claim 20, wherein the single wall insertion end portion includes a plurality of notches that extend axially from the insertion end portion to the shielding end portion.

22. The protective cap of claim 20, wherein the insertion end portion includes a plurality of external projections for engagement with a helical groove formed on an inner surface of the support cup.

23. The protective cap of claim 20, wherein the shielding end portion is partially circumscribed about the cap axis.

24. The protective cap of claim 18, wherein the outer surface of the tubular member defines an external shelf for engaging the support cup.

25. The protective cap of claim 18, wherein the plurality of slots includes a pair of slots opposed about the baffle, each slot in the pair of slots defining an arc length spanning over 90 degrees with respect to the cap axis.

26. The protective cap of claim 18, wherein the internal baffle includes a central disc and a pair of connectors diametrically opposed about the central disc to interconnect the central disc to the inner surface of the tubular member with the slots extending between the connectors.

27. The protective cap of claim 18, wherein the internal baffle includes a central handle extending axially beyond the second end to define a total length of the protective cap, the tubular member having an axial length being at least 50% of the total length of the protective cap.

28. A method of protecting a sprinkler assembly having a frame, a deflector and a support cup having an end cap with a central opening centered about a cup axis and disposed about the sprinkler frame, the end cap including a plurality of apertures angularly spaced about the central opening to define an arc length about the cup axis between two angularly adjacent spaced apertures, the method comprising:

engaging a tubular member with the support cup to define an internal volume between the endcap of the support cup and an internal baffle formed within the tubular member with an inner surface of the tubular member circumscribed about the sprinkler assembly; and defining a tool path with a plurality of slots formed about the internal baffle and in fluid communication with the internal volume to access a tool engagement portion of the sprinkler assembly during installation of the sprinkler assembly, each slot in the plurality of slots has a slot length spanning over an arc length with respect to a central axis of the tubular member that is greater than the arc length between the two angularly adjacent spaced apertures of the plurality of apertures of the support cup.

29. The method of claim 28, wherein the engaging includes locating a first end of the tubular member in the support cup at a fixed distance from the plurality of apertures formed in the end cap of the support cup.

30. The method of claim 28, further comprising inserting a tool along the tool path through the plurality of slots defined by a pair of arcuate slots formed between the internal baffle and the inner surface of the tubular member; and accessing the tool engagement portion of the sprinkler with the tool extending through the internal volume.

31. The method of claim 28, wherein the engaging includes abutting an external shelf formed about the tubular member with a receiving end of the support cup.

32. The method of claim 28, wherein the engaging includes rotationally engaging projections formed on an external surface of the tubular member with a helical groove formed internally on the support cup.

33. The method of claim 28, further comprising axially pulling the tubular member out of a receiving end of the support cup with a tool along the tool path.

34. The method of claim 28, further comprising:

inserting a tool through the plurality of slots along the tool path;

rotating the tool relative to the tubular member; and axially pulling the tubular member out of the support cup.

* * * * *